US010404008B2

(12) United States Patent
Miller et al.

(10) Patent No.: US 10,404,008 B2
(45) Date of Patent: Sep. 3, 2019

(54) CONNECTOR SYSTEM WITH RECEPTACLE AND PLUG CONNECTORS HAVING COMPLIMENTARY ANGLED CONNECTOR PLATFORMS

(71) Applicant: TE CONNECTIVITY CORPORATION, Berwyn, PA (US)

(72) Inventors: Keith Edwin Miller, Manheim, PA (US); Kevin Michael Thackston, York, PA (US); Robert Neil Mulfinger, York Haven, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/968,840

(22) Filed: May 2, 2018

(65) Prior Publication Data

US 2019/0109414 A1 Apr. 11, 2019

Related U.S. Application Data

(60) Provisional application No. 62/568,992, filed on Oct. 6, 2017.

(51) Int. Cl.
*H01R 13/627* (2006.01)
*H01R 13/52* (2006.01)
(Continued)

(52) U.S. Cl.
CPC ..... *H01R 13/6273* (2013.01); *H01R 13/5219* (2013.01); *H01R 13/6275* (2013.01);
(Continued)

(58) Field of Classification Search
CPC ..... H01R 13/6273; H01R 13/5202; H01R 13/5205; H01R 13/5219; H01R 13/5221
USPC ..... 439/284, 271
See application file for complete search history.

(56) References Cited

U.S. PATENT DOCUMENTS 5,174,761 A * 12/1992 Kodaira ..... H01R 35/04 439/11
6,146,175 A 11/2000 Shibata
(Continued)

FOREIGN PATENT DOCUMENTS

EP 0 694 998 A2 1/1996
WO 2007/113578 A1 10/2007

OTHER PUBLICATIONS

International Search Report, Application No. PCT/IB2018/057556, International Filing Date, Sep. 28, 2018.

*Primary Examiner* — Tulsidas C Patel
*Assistant Examiner* — Peter G Leigh

(57) ABSTRACT

A connector system includes a receptacle connector having a receptacle housing including a cavity accessible through a front opening and a top opening. The receptacle connector has a receptacle connector platform supporting receptacle contacts being angled. The connector system includes a first plug connector received in the cavity through the front opening including a plug housing holding plug conductors. The plug housing has a plug connector platform having a mating interface with the plug conductors exposed at the mating interface. The plug connector platform is angled at a complementary angle to the receptacle connector platform for mating the plug conductors with the receptacle contacts.

20 Claims, 4 Drawing Sheets

(51) Int. Cl.

| | |
|---|---|
| ***H01R 25/00*** | (2006.01) |
| ***H01R 13/66*** | (2006.01) |
| ***H01R 24/20*** | (2011.01) |
| ***H01R 24/28*** | (2011.01) |
| ***H01R 24/62*** | (2011.01) |
| ***H01R 31/06*** | (2006.01) |
| *H01R 107/00* | (2006.01) |

(52) U.S. Cl.
CPC ..... *H01R 13/6658* (2013.01); *H01R 24/20* (2013.01); *H01R 24/28* (2013.01); *H01R 24/62* (2013.01); *H01R 25/003* (2013.01); *H01R 31/06* (2013.01); *H01R 2107/00* (2013.01)

(56) References Cited

U.S. PATENT DOCUMENTS 6,752,663 B2 * 6/2004 Bright ..... G02B 6/4201 439/607.25
6,893,293 B2 * 5/2005 Ice ..... G02B 6/4277 439/607.2
7,192,320 B2 * 3/2007 Yasumura ..... H01R 13/2407 439/862
7,433,193 B2 * 10/2008 Yee ..... G02B 6/4246 165/80.3
7,651,336 B2 * 1/2010 Yasumura ..... H01R 13/6587 439/65
8,460,006 B2 6/2013 Debock et al.
9,017,092 B1 * 4/2015 McCracken ..... H01R 13/62 439/374
9,048,584 B2 6/2015 Thackston et al.
9,178,316 B1 * 11/2015 McCracken ..... H01R 13/62
9,532,608 B2 * 1/2017 Tsang ..... H01R 13/518
9,728,915 B2 * 8/2017 Aldehayyat ..... H01R 24/58
2005/0170685 A1 * 8/2005 Satou ..... H01R 12/79 439/495
2006/0094306 A1 5/2006 Masaki et al.
2014/0213119 A1 7/2014 Thackston et al.
2017/0222360 A1 * 8/2017 McCracken ..... H01R 13/6315

* cited by examiner

CONNECTOR SYSTEM WITH RECEPTACLE AND PLUG CONNECTORS HAVING COMPLIMENTARY ANGLED CONNECTOR PLATFORMS

CROSS REFERENCE TO RELATED APPLICATIONS

This application claims benefit to U.S. Provisional Application No. 62/568,992, filed Oct. 6, 2017, titled "CONNECTOR SYSTEM", the subject matter of which is herein incorporated by reference in its entirety.

BACKGROUND OF THE INVENTION

The subject matter herein relates generally to a connector system.

Electrical connector systems are used to electrically connect a wide variety of electronic devices. Connectors are sometimes integrated into clothing, apparel, and/or other wearable articles worn by an individual in a variety of different applications, such as, but not limited to, first responders (e.g. fire and police), maintenance technicians, soldiers, and/or the like. Known connectors that are integrated into wearable articles are not without problems. For example, in some environments, such as when the connectors are being used outside or in other harsh environments, contaminants such as dirt, mud, grease, sand, and/or other debris, and/or fluids such as water and/or oil may get trapped within a receptacle connector. Contaminants may enter the receptacle while the receptacle connector is disconnected from the complementary plug connector, or while the connectors are mated if the mating interface is not sealed. Such contaminants may contaminate the mating interface of the connector and/or otherwise impede mating of the plug and receptacle connectors, which for example may interrupt the electrical connection and/or damage the connector(s). Removal of such contaminants may be difficult and/or time consuming. For example, it may be difficult to clean the mating interface of a connector in the field. Moreover, attempting to clean the mating interface of a connector may damage of the conductors of the connector. For example, using tools, fingers, thumbs, cloths, and/or the like to remove the contaminants may damage the conductors. Some contaminants may be permanently trapped beneath the conductors of a connector.

Another disadvantage of some known electrical connectors is vulnerability to liquid and/or moisture (e.g., water, a corrosive liquid, an acidic liquid, and/or the like). For example, some known electrical connectors may be used in environments wherein the connector is exposed to a liquid and/or moisture. Exposure of the mating interface of an electrical connector to a liquid and/or moisture may interfere with operation of the electrical connector. For example, exposure of the mating interface of an electrical connector to a liquid and/or moisture may prevent the electrical connector from conducting electrical power and/or electrical data signals.

BRIEF DESCRIPTION OF THE INVENTION

In one embodiment, a connector system is provided including a receptacle connector having a receptacle housing having a front and a rear opposite the front. The front has a front opening. The receptacle housing has a top and a bottom with the top having a top opening open to the front opening. The receptacle housing has a cavity accessible through the front opening and the top opening. The receptacle connector has a receptacle connector platform below the cavity supporting receptacle contacts. The receptacle connector platform is angled relative to the front and being angled relative to the top. The connector system includes a first plug connector received in the cavity through the front opening. The first plug connector has a plug housing holding plug conductors. The plug housing has a top and a bottom and a mating end and a cable end with a cable extending from the cable end. The plug housing has a plug connector platform at the bottom having a mating interface with the plug conductors exposed at the mating interface. The plug connector platform is angled at a complementary angle to the receptacle connector platform for mating the plug conductors with the receptacle contacts.

In another embodiment, a connector system is provided including a receptacle connector having a receptacle housing having a front and a rear opposite the front with a front opening, a rear opening, a top, a bottom, a top opening and a cavity accessible through the front opening, the rear opening and the top opening. The receptacle connector has a base below the cavity at the bottom of the receptacle housing having a front receptacle connector platform proximate to the front and a rear receptacle connector platform proximate to the rear. The front receptacle connector platform is angled relative to the front and angled relative to the top and the rear receptacle connector platform is angled relative to the rear and angled relative to the top. The base supports receptacle contacts extending between and exposed at the front receptacle connector platform and the rear receptacle connector platform. A first plug connector is received in the cavity through the front opening having a first plug housing holding first plug conductors. The first plug housing has a top and a bottom, a mating end and a cable end with a cable extending from the cable end. The first plug housing has a first plug connector platform at the bottom having a first mating interface with the first plug conductors exposed at the first mating interface. The first plug connector platform is angled at a complementary angle to the first receptacle connector platform for mating the first plug conductors with the receptacle contacts. A second plug connector is received in the cavity through the rear opening having a second plug housing holding second plug conductors. The second plug housing has a top and a bottom, a mating end and a cable end with a cable extending from the cable end. The second plug housing has a second plug connector platform at the bottom having a second mating interface with the second plug conductors exposed at the second mating interface. The second plug connector platform is angled at a complementary angle to the second receptacle connector platform for mating the second plug conductors with the receptacle contacts. The receptacle contacts electrically connect the first and second plug conductors.

In a further embodiment, a connector system is provided including a receptacle connector having a receptacle housing having a front and a rear opposite the front. The front has a front opening. The receptacle housing has a top and a bottom with the top having a top opening open to the front opening. The receptacle housing has a cavity accessible through the front opening and the top opening. The receptacle connector has a receptacle connector platform below the cavity supporting receptacle contacts. The receptacle connector platform is angled relative to the front and the being angled relative to the top. A first plug connector is received in the cavity through the front opening. The first plug connector has a plug housing holding a circuit board having plug conductors defined by circuits of the circuit board at a mating side of the circuit board. The plug housing has a top and a bottom. The plug housing has a mating end and a cable end with a cable extending from the cable end. The cable is terminated to the circuit board to electrically connect with corresponding plug conductors. The plug housing has a plug connector platform at the bottom having a mating interface. The mating side of the circuit board and the plug conductors are exposed at the mating interface. The plug connector platform is angled at a complementary angle to the receptacle connector platform for mating the plug conductors with the receptacle contacts.

DETAILED DESCRIPTION OF THE INVENTION

Figure 1:
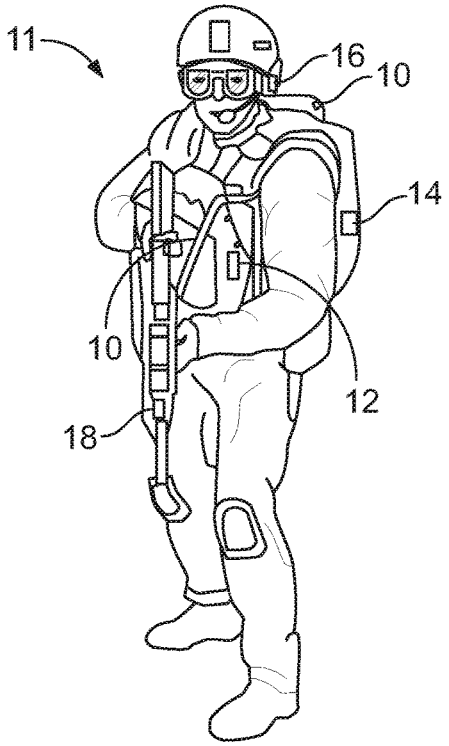
FIG. 1 illustrates a connector system formed in accordance with an exemplary embodiment.

FIG. 1 illustrates a connector system 10 formed in accordance with an exemplary embodiment and used to electrically connect various equipment carried by a user 11, such as a military soldier, a first responder, or another user having wearable electronics. The connector system 10 provides the user 11 with releasable connections between the equipment that is configured to withstand exposure to contaminants such as dirt, mud, and sand. In an exemplary embodiment, the connector system 10 uses pass-through connectors that allow contaminants to be easily cleared from the connector system 10.

The connector system 10 may include e-textiles or fabrics that enable computing, digital components and/or electronics to be embedded therein. The e-textiles may be incorporated into wearable articles, such as vests, shirts, pants, backpacks, and the like, that incorporate built-in technological elements into the fabric of the garment, wiring in the garment, in pockets of the garment or attached to the inside or outside of the garment.

The connector system 10 is used to interconnect various electronic devices, such as a first electronic device 12, a second electronic device 14, a third electronic device 16 and a fourth electronic device 18. Any number of electronic devices may be utilized in the connector system 10. In an exemplary embodiment, the first electronic device 12 constitutes a battery pack held in a pocket of a vest worn by the user 11. The second electronic device 14 constitutes a radio held in a backpack worn by the user 11. The third electronic device 16 constitutes a headset in a helmet worn by the user 11. The fourth electronic device 18 constitutes a light attached to a gun held by the user 11. The first electronic device 12 is electrically connected to the other electronic devices 14, 16, 18 via cables and connectors of the connector system 10, such as to power the electronic devices 14, 16, 18. The second and third electronic devices 14, 16 are electrically connected via cables and connectors of the connector system 10, such as to send data signals therebetween for communication between the headset and the radio.

The above electronic devices are merely examples of electronic devices that may be interconnected by the connector system 10. Other types of devices may be used in alternative embodiments depending on the user's needs, such as a computer, video recorder, personal radio, loop antenna, heating element, display screen, input device, sensor, induction loop or other components known to the industry. In addition to military applications, the connector system 10 may be used by other types of users such as in first responder applications, police applications, firefighting applications, automotive applications, industrial applications, commercial applications, and the like.

Figure 2:
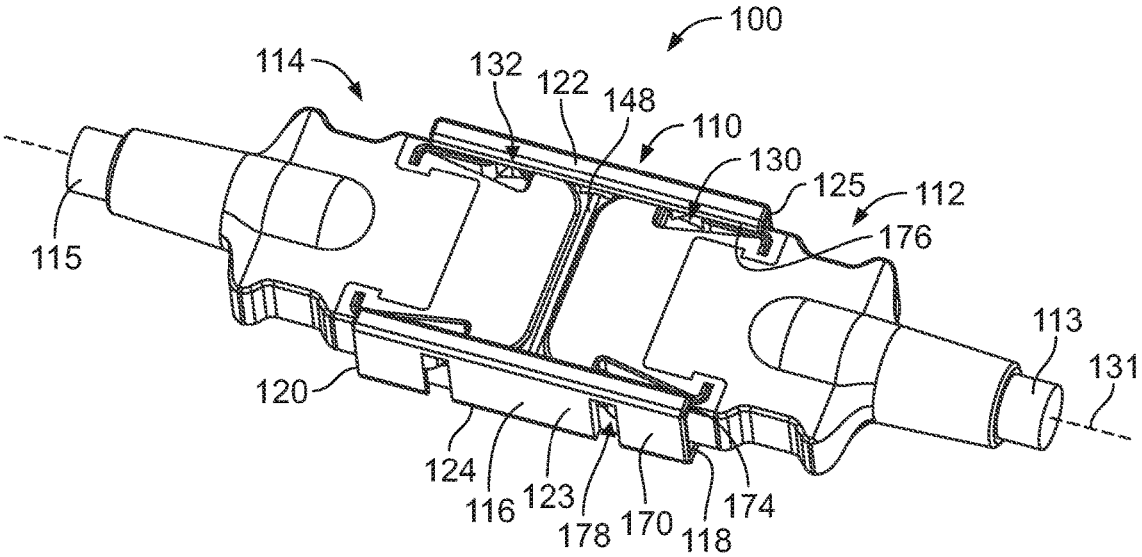
FIG. 2 is a top perspective view of a connector system formed in accordance with an exemplary embodiment showing components thereof in a mated state.
Figure 3:
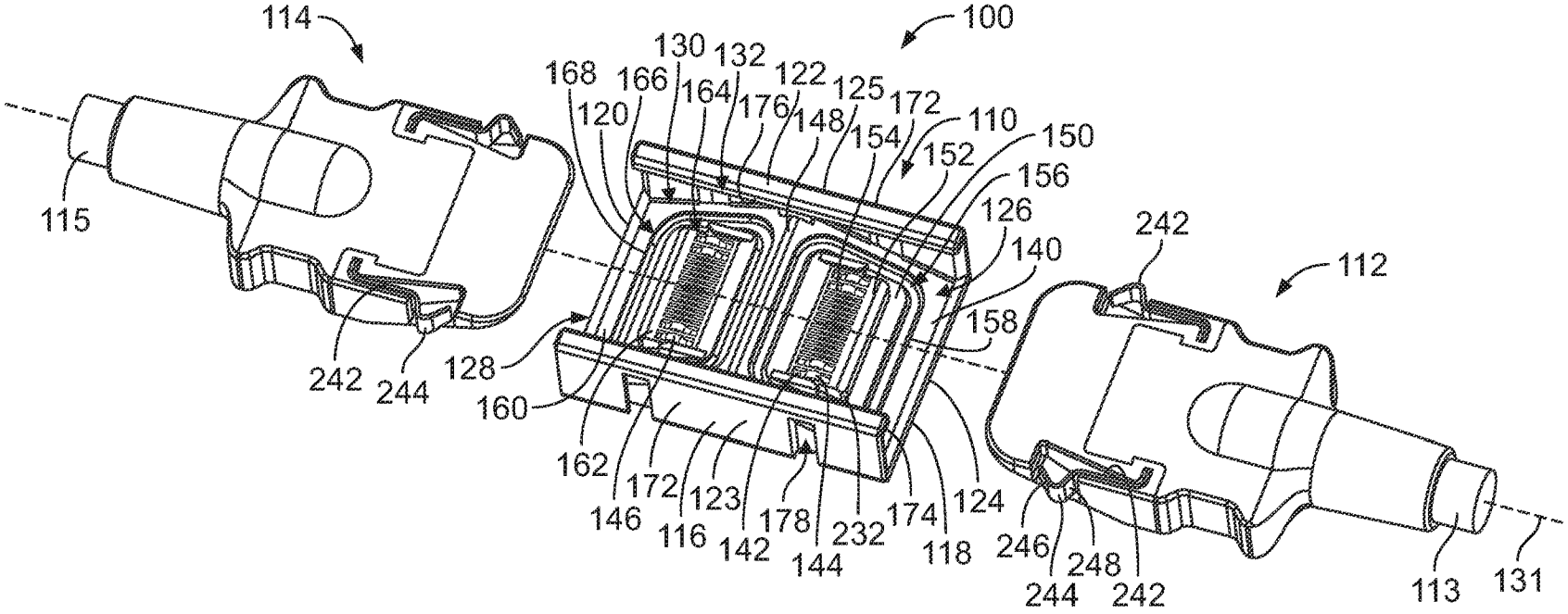
FIG. 3 is a top perspective view of the connector system showing components thereof in an unmated state.

FIG. 2 is a top perspective view of a connector system 100 formed in accordance with an exemplary embodiment showing components thereof in a mated state. FIG. 3 is a top perspective view of the connector system 100 showing components thereof in an unmated state. The connector system 100 may be used in place of the connector system 10 (shown in FIG. 1).

The connector system 100 includes a receptacle connector 110, a first plug connector 112 and a second plug connector 114. Optionally, the first and second plug connectors 112, 114 may be identical and like components of the second plug connector 114 are identified with like reference numbers. The description herein may generally refer to the first plug connector 112; however, such description may be equally applicable to the second plug connector 114. Qualifying terms "first" and "second" may be used when referring to the first plug connector 112 and the second plug connector 114, respectively.

The plug connectors 112, 114 are configured for mating with the receptacle connector 110. The plug connectors 112, 114 are configured to be releasably connected, or mated, to the receptacle connector 110. In an exemplary embodiment, the connectors 112, 114 are electrically connected to each other within the receptacle connector 110 to establish an electrical connection therebetween. For example, in an exemplary embodiment, the receptacle connector 110 includes receptacle contacts used to electrically connect the plug connectors 112, 114.

In the illustrated embodiment, the first plug connector 112 is terminated to an end of a cable 113 and the second plug connector 114 is terminated to an end of a cable 115. Power and or data signals may be transmitted along the cables 113, 115 and through the plug connectors 112, 114 when mated. While the connectors 112, 114 are illustrated as being terminated to cables 113, 115, the connectors 112, 114 may be terminated to other components, such as directly to a printed circuit board (PCB), a flex circuit, within another structure such as a helmet, an e-textile, a gun and the like with conductors, such as wires, contacts and the like terminated thereto.

The receptacle connector 110 includes a housing 116 having a front 118, a rear 120, a top 122, a bottom 124 and opposite first and second sides 123, 125. The housing 116 may have any shape, such as rectangular, cylindrical, spherical, or spheroidal shapes, for example. The housing 116 may have any size and shape depending on the type of electronic device (e.g., backpack, vest, helmet, glove, gun, pants, shirt, accessory and the like) that incorporates the receptacle connector 110. The housing 116 includes a front opening 126 at the front 118 and a rear opening 128 at the rear 120 with a cavity 130 extending between the front and rear openings 126, 128. The cavity 130 extends along a mating axis 131 between the front 118 and the rear 120. The first plug connector 112 is configured to be loaded into the cavity 130 through the front opening 126 along the mating axis 131 and the second plug connector 114 is configured to be loaded into the cavity 130 through the rear opening 128 along the mating axis 131; however, in various embodiments, either plug connector 112, 114 may be loaded into either opening 126, 128.

In an exemplary embodiment, the receptacle connector 110 includes a top opening 132 open at the top 122. The top opening 132 may extend the entire length of the receptacle connector 110 between the front 118 and the rear 120. The top opening 132 may extend the entire width of the receptacle connector 110 between the first side 123 and the second side 125. The top opening 132 provides access to the cavity 130, such as for cleaning components of the receptacle connector 110 for removing contaminants and debris from the cavity 130.

In an exemplary embodiment, the cavity 130 is open at the front and rear openings 126, 128 to define a pass-through connector. The cavity 130 allows the plug connectors 112, 114 to pass at least partially through the receptacle connector 110 for mating to the receptacle connector 110. Having the cavity 130 open at the front 118 and the rear 120 allows contaminants to pass through and be ejected from the receptacle connector 110. The receptacle connector 110 may be easily cleaned and the contaminants may be easily removed from the cavity 130.

The receptacle connector 110 includes a base 140 at the bottom 124 of the receptacle connector 110. The base 140 is positioned below the cavity 130. The base 140 extends between the front 118 and the rear 120. The base 140 extends between the first side 123 and the second side 125. In an exemplary embodiment, the base 140 holds a plurality of receptacle contacts 142. Each receptacle contact 142 extends between a first mating end 144 and a second mating end 146. The first mating ends 144 are configured to be electrically connected to the first plug connector 112. The second mating ends 146 are configured to be electrically connected to the second plug connector 114. The receptacle contacts 142 electrically connect the first plug connector 112 and the second plug connector 114. The first and second mating ends 144, 146 are provided on opposite sides of a mid-wall 148 of the base 140. Optionally, the mid-wall 148 may be approximately centered between the front 118 and the rear 120. The mating ends 144, 146 may be spring-type contacts configured to be deflected or bowed when mated to apply a spring force when mating to the first and second plug connectors 112, 114. Other types of contacts may be used in alternative embodiments, such as pin contacts, socket contacts, blade contacts, pad contacts, and the like. The mating ends 144, 146 may be oriented in a direction parallel to and along the mating axis 131 between the front and rear openings 126, 128. The mating contacts 144, 146 may have other orientations, such as being perpendicular to the mating axis 131 or at another angle thereto.

The receptacle connector 110 includes a front receptacle connector platform 150 at the base 140 proximate to the front 118. The first mating ends 144 of the receptacle contacts 142 are exposed at the front receptacle connector platform 150 for mating with the first plug connector 112. In an exemplary embodiment, the front receptacle connector platform 150 is angled relative to the front 118 and angled relative to the top 122. For example, the front receptacle connector platform 150 is forward and upward facing in the illustrated embodiment. For example, the front receptacle connector platform 150 is lower at the front 118 and higher at the mid-wall 148.

In an exemplary embodiment, the front receptacle connector platform 150 includes a backing plate 152 behind the receptacle contacts 142. The backing plate 152 holds the mating ends 144 of the receptacle contacts 142. In an exemplary embodiment, the backing plate 152 substantially fills the space behind the mating ends 144 such that contaminants and debris are unable to get caught behind the mating ends 144. The backing plate 152 defines a mating plane for the first plug connector 112. The mating ends 144 are arranged along the mating plane. Optionally, the mating plane may be angled relative to the front receptacle connector platform 150. For example, the mating plane defined by the top of the backing plate 152 may be generally horizontal while the front receptacle connector platform 150 may be angled relative to the horizontal plane.

In an exemplary embodiment, the front receptacle connector platform 150 includes a plurality of contact channels 154 receiving corresponding receptacle contacts 142. The contact channels 154 may extend through the backing plate 152. The mating ends 144 may extend from the contact channels 154 above the backing plate 152 for mating with the first plug connector 112. Optionally, the receptacle contacts 142 are deflectable when mated with the first plug connector 112. For example, the mating ends 144 may be pressed into the contact channels 154 when mated with the first plug connector 112.

In an exemplary embodiment, the front receptacle connector platform 150 includes a seal surface 156 configured to seal against an environmental seal 158. In the illustrated embodiment, the seal surface 156 is formed by a groove extending entirely circumferentially around the backing plate 152 and the mating ends 144 of the receptacle contacts 142. The groove receives and holds the environmental seal 158 for mating with the first plug connector 112. Alternatively, the environmental seal 158 may be held by the first plug connector 112 and mated to the seal surface 156, which may include the groove or may be a planar surface. The environmental seal 158 is used to seal off the mating interface between the receptacle connector 110 and the first plug connector 112 from moisture or other contaminants. The environmental seal 158 may be a compression seal. The environmental seal 158 may be a gasket.

The receptacle connector 110 includes a rear receptacle connector platform 160 at the base 140 proximate to the rear 120. The second mating ends 146 of the receptacle contacts 142 are exposed at the rear receptacle connector platform 160 for mating with the second plug connector 114. In an exemplary embodiment, the rear receptacle connector platform 160 is angled relative to the rear 120 and angled relative to the top 122. For example, the rear receptacle connector platform 160 is rearward and upward facing in the illustrated embodiment. For example, the rear receptacle connector platform 160 is lower at the rear 120 and higher at the mid-wall 148.

In an exemplary embodiment, the rear receptacle connector platform 160 includes a backing plate 162 behind the receptacle contacts 142. The backing plate 162 holds the mating ends 146 of the receptacle contacts 142. In an exemplary embodiment, the backing plate 162 substantially fills the space behind the mating ends 146 such that contaminants and debris are unable to get caught behind the mating ends 146. The backing plate 162 defines a mating plane for the second plug connector 114. The mating ends 146 are arranged along the mating plane. Optionally, the mating plane may be angled relative to the rear receptacle connector platform 160. For example, the mating plane defined by the top of the backing plate 162 may be generally horizontal while the rear receptacle connector platform 160 may be angled relative to the horizontal plane.

In an exemplary embodiment, the rear receptacle connector platform 160 includes a plurality of contact channels 164 receiving corresponding receptacle contacts 142. The contact channels 164 may extend through the backing plate 162. The mating ends 146 may extend from the contact channels 164 above the backing plate 162 for mating with the second plug connector 114. Optionally, the receptacle contacts 142 are deflectable when mated with the second plug connector 114. For example, the mating ends 146 may be pressed into the contact channels 164 when mated with the second plug connector 114.

In an exemplary embodiment, the rear receptacle connector platform 160 includes a seal surface 166 configured to seal against an environmental seal 168. In the illustrated embodiment, the seal surface 166 is formed by a groove extending entirely circumferentially around the backing plate 162 and the mating ends 146 of the receptacle contacts 142. The groove receives and holds the environmental seal 168 for mating with the second plug connector 114. Alternatively, the environmental seal 168 may be held by the second plug connector 114 and mated to the seal surface 156, which may include the groove or may be a planar surface. The environmental seal 168 is used to seal off the mating interface between the receptacle connector 110 and the second plug connector 112 from moisture or other contaminants. The environmental seal 168 may be a compression seal. The environmental seal 168 may be a gasket.

In an exemplary embodiment, the housing 116 includes a first side wall 170 extending upward from the base 140 at the first side 123 and a second side wall 172 extending upward from the base at the second side 125. The sidewalls 170, 172 include ledges 174, 176, respectively. The top opening 132 extends between the side walls 170, 172, such as between the ledges 174, 176. The ledges 174, 176 are used to capture the first and second plug connectors 112, 114 in the cavity 130. The ledges 174, 176 prevent lift off of the first and second plug connectors 112, 114 from the front and rear receptacle connector platforms 150, 160. The first and second plug connectors 112, 114 are configured to be loaded into the cavity 130 below the ledges 174, 176. The ledges 174, 176 and hold the first and second plug connectors 112, 114 against the front and rear receptacle connector platforms 150, 160 when the first and second plug connectors 112, 114 are fully loaded into the cavity 130.

In an exemplary embodiment, the housing 116 includes latching features in the first and second sidewalls 170, 172 used to secure the first and second plug connectors 112, 114 in the cavity. In the illustrated embodiment, the latching features 178 are openings in the first and second side walls 170, 172. Other types of latching features 178 may be provided in alternative embodiments, such as slots, channels, tabs, deflectable spring beams, or other types of latching features.

In an exemplary embodiment, the front and rear receptacle connector platforms 150, 160 are angled relative to the ledges 174, 176. For example, the ledges 174, 176 may be generally horizontal while the first and second plug connectors 112, 114 are angled non-horizontal and non-vertical. In an exemplary embodiment, the front receptacle connector platform 150 is angled away from the rear receptacle connector platform 160 and the rear receptacle connector platform 160 is angled away from the front receptacle connector platform 150. The mid-wall 148 separates the front and rear receptacle connector platforms 150, 160.

Figure 4:
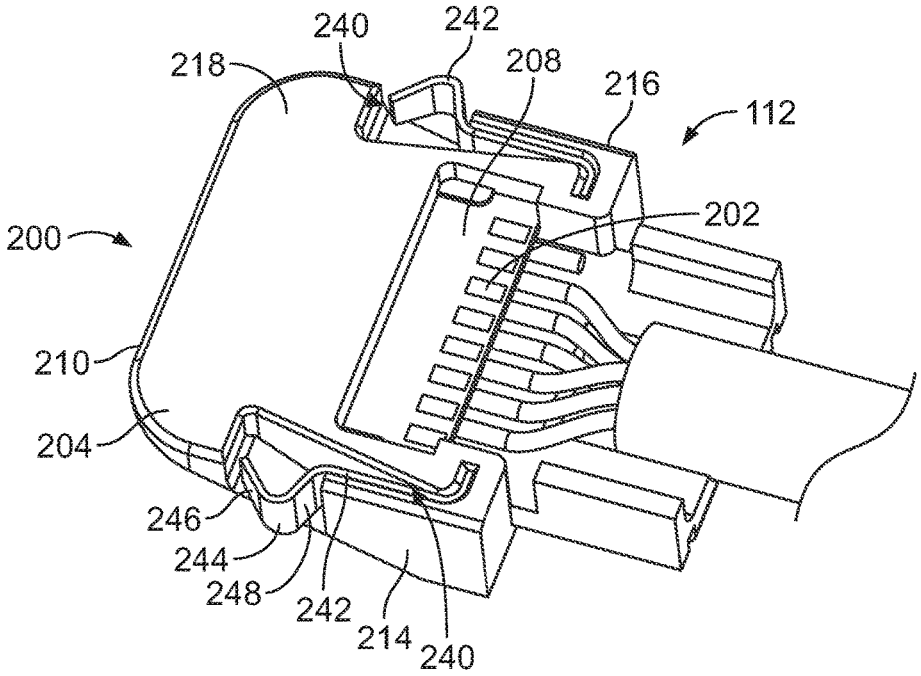
FIG. 4 is a top perspective view of a portion of a plug connector of the connector system.
Figure 5:
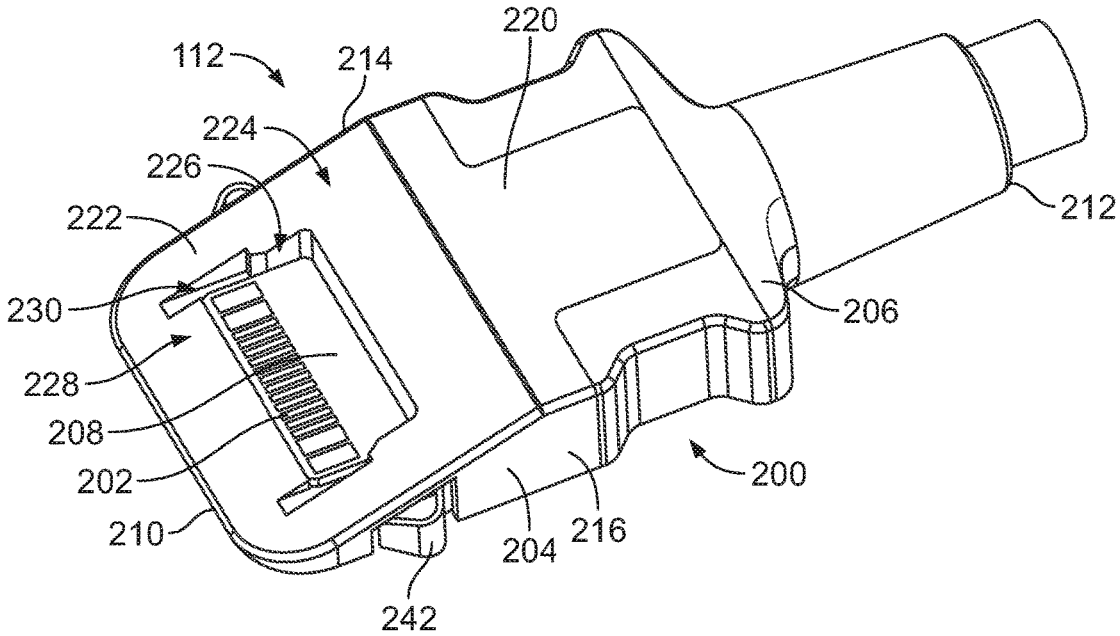
FIG. 5 is a bottom perspective view of a portion of the plug connector.

FIG. 4 is a top perspective view of a portion of the first plug connector 112. FIG. 5 is a bottom perspective view of a portion of the first plug connector 112. As noted above, in various embodiments, the first and second plug connectors 112, 114 may be identical and like components of the second plug connector 114 described herein are identified with like reference numbers.

The plug connector 112 includes a plug housing 200 that houses plug conductors 202. In an exemplary embodiment, the plug housing 200 includes a front shell 204 and a rear shell 206. The rear shell 206 may be coupled to or formed on the front shell 204. For example, in various embodiments, the rear shell 206 may be molded in place on the front shell 204 around other components of the plug connector 112.

In an exemplary embodiment, the plug connector 112 includes a circuit board 208 received in the plug housing 200. The plug conductors 202 may be defined by the circuit board 208. For example, the plug conductors 202 may be defined by circuits of the circuit board 208 routed through one or more layers of the circuit board 208. The circuits may include pads, traces, vias or other types of conductors. In an exemplary embodiment, wires of the cable 113 may be terminated to the plug conductors 202 on the circuit board 208. For example, the wires may be soldered to the plug connectors 202. In other various embodiments, the plug conductors 202 may include contacts or terminals extending from the circuit board 208 in addition to circuits of the circuit board 208. The wires may be terminated to such contacts or terminals. The contacts or terminals may define mating components for mating with the receptacle contacts 142. In the illustrated embodiment, the circuit board 208 is received in the front shell 204. The rear shell 206 covers the terminations of the wires to the plug conductors 202 and may be formed around the cable 113 to provide strain relief for the cable 113. For example, the rear shell 206 may include a ferrule around the cable 113.

In alternative embodiments, rather than including the circuit board 208, the plug housing 200 may hold individual contacts defining the plug conductors 202. For example, the plug conductors 202 may be stamped and formed copper contacts used for data or power transmission. Optionally, the plug conductors 202 may include spring terminals at mating ends thereof configured to be deflected relative to the plug housing 200 during mating with the receptacle connector 110. The plug conductors 202 may be spring-type contacts configured to be deflected or bowed when mated to apply a spring force when mating to the plug conductors 202 of the receptacle connector 110. Other types of contacts may be used in alternative embodiments, such as pin contacts, socket contacts, blade contacts, pad contacts, and the like.

The first plug connector 112 may be any size and shape that allows the plug conductors 202 to be loaded into the receptacle connector 110 and make contact with the front receptacle connector platform 150. The plug housing 200 includes a front 210 and a rear 212. The plug housing 200 includes first and second sides 214, 216 extending between the front 210 and the rear 212. The plug housing 200 includes a top 218 extending between the sides 214, 216. The plug housing includes a bottom 220 opposite the top 218. The bottom 220 includes a plug connector platform 222 configured to interface with the front receptacle connector platform 150. In an exemplary embodiment, the plug connector platform 222 is angled and a complementary angle to the angle of the front receptacle connector platform 150 for mating thereto. The plug connector platform 222 includes a seal surface 224 for sealing against the environmental seal 158.

In an exemplary embodiment, the plug housing 200 includes a pocket 226 in the plug connector platform 222. A portion of the circuit board 208 is exposed in the pocket 226. The plug conductors 202 are exposed in the pocket 226 for mating with the receptacle contacts 142. In the illustrated embodiment, the circuit board 208 is arranged horizontally and is thus angled relative to the angled plug connector platform 222. The plug connector platform 222 and the plug conductors 202 define a mating interface 228 for mating with the receptacle connector 110. Optionally, the plug housing 200 may include plug guide features 230 configured to engage corresponding receptacle guide features 232 (shown in FIG. 3) on the receptacle connector 110 to locate the plug housing 200 relative to the receptacle housing 116. In the illustrated embodiment, the plug guide features 230 are slots formed in the plug connector platform 222. The slots may be open to the pocket 226.

In an exemplary embodiment, the plug housing 200 includes latch channels 240 that receive latches 242. In the illustrated embodiment, the latch channels 240 are formed in the top 218 at the first and second sides 214, 216. The latches 242 include latching features 244 that extend outward from the plug housing 200 to engage the latching features 178 of the receptacle connector 110. In the illustrated embodiment, the latching features 244 are spring beams configured to latch of the engage the receptacle connector 110. The latching features 244 may be deflectable. The latch channels 240 may form a space to allow the latching features 244 to deflect inward into the plug housing 200 during mating and on mating. In the illustrated embodiment, the latching features 244 include front walls 246 and rear walls 248. The front walls 246 are generally forward facing and the rear walls 248 are generally rearward facing. In an exemplary embodiment, the front walls 246 are angled to define the ramps configured to engage the receptacle connector 110 and deflect the latching features 244 when loading the first plug connector 112 into the receptacle connector 110. In an exemplary embodiment, the rear walls 248 are angled to define ramps configured to engage the receptacle connector 110 and deflect the latching features 244 when unloading the first plug connector 112 from the receptacle connector 110.

Referring back to FIGS. 2 and 3, the latching features 244 are configured to be received in the latching features 178 to secure the first plug connector 112 in the receptacle connector 110. For example, when the first plug connector 112 is fully loaded in the receptacle connector 110, the latching features 244 are aligned with the latching features 178 and the latching features 244 deflect outward into the latching features 178. The rear walls 248 engage the edges of the opening defining the latching features 178 to resist removal of the first plug connector 112 from the receptacle connector 110. However, the holding force may be overcome by pulling rearward on the first plug connector 112 hard enough to overcome the spring force of the latches 242. The ramped rear walls 248 may be used to deflect the latching features 244 inward as the first plug connector 112 is removed from the receptacle connector 110. During loading of the first plug connector 112 into the receptacle connector 110, the front walls 246 engage the first and second side walls 170, 172 at the front 118. The ramped front walls 246 are used to deflect the latching features 244 inward as the first plug connector 112 is loaded into the receptacle connector 110.

In an exemplary embodiment, the angled rear walls 248 provide a pulling force on the first plug connector 112 to pull the first plug connector 112 into the receptacle connector 110. The latches 242 pull the first plug connector 112 against the environmental seal 158. The latches 242 that drive the first plug connector 112 into the cavity 130 to hold the first plug connector 112 against the receptacle contacts 142.

Figure 6:
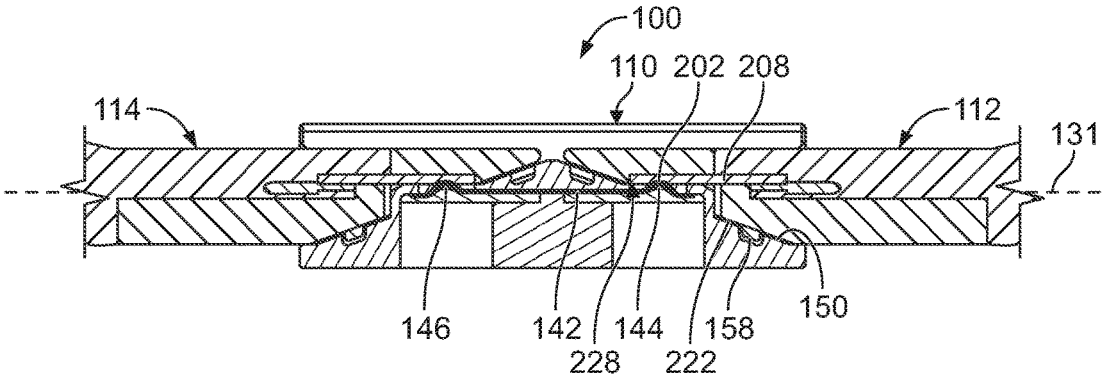
FIG. 6 is a cross-sectional view of the connector system in accordance with an exemplary embodiment.

FIG. 6 is a cross-sectional view of the connector system 100 in accordance with an exemplary embodiment. FIG. 6 illustrates the first and second plug connectors 112, 114 plugged into the receptacle connector 110. The receptacle contacts 142 are used to electrically connect the first and second plug connectors 112, 114. For example, the mating ends 144, 146 engage corresponding first and second plug conductors 202 to create an electrical path between the first and second plug connectors 112, 114.

When the plug connector 112 is loaded into the receptacle connector 110, the plug connector platform 222 engages the front receptacle connector platform 150. The environmental seal 158 seals the mating interface 228 between the plug connector 112 and the receptacle connector 110. In the illustrated embodiment, the circuit board 208 is oriented parallel to the mating axis 131. The plug conductors 202 wipe along the mating ends 144 during mating to create a sufficient electrical connection between the plug conductors 202 and the receptacle contacts 142. The environmental seal 158 seals the mating interface 228 when the plug connector 112 is fully loaded into the receptacle connector 110. Prior to fully loading, the plug connector 112 does not engage or rub against the environmental seal 158. It is only at the last stage of mating that the plug connector 112 engages and compresses the environmental seal 158. The angled orientation of the environmental seal 158 enables adequate sealing without high insertion force or excessive seal where due to high number of mating cycles. The plug connector platform 222 provides a large surface area that is continuous around the mating interface 228 and uninterrupted to interface with the environmental seal 158 to maintain a high level of seal performance.

Figure 7:
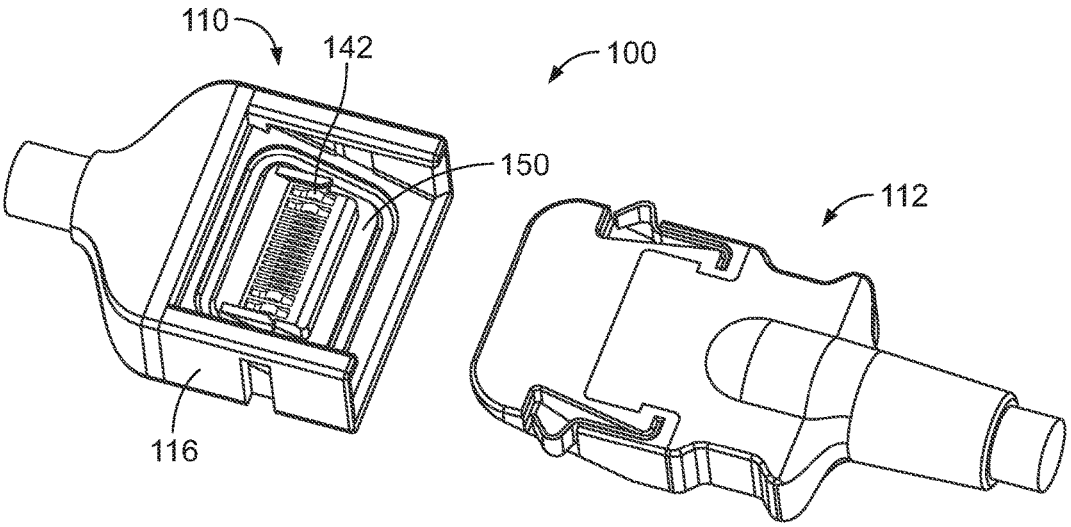
FIG. 7 is a perspective view of the connector system in accordance with an exemplary embodiment.

FIG. 7 is a perspective view of the connector system 100 in accordance with an exemplary embodiment. In the illustrated embodiment, the receptacle connector 110 includes a single interface for mating with a single plug connector 112. The receptacle connector 110 includes the front receptacle connector platform 150 and eliminates the rear receptacle connector platform 160 (shown in FIG. 3). The receptacle housing 116 is terminated to an end of a cable. The wires of the cable are terminated to corresponding receptacle contacts 142. The plug connector 112 is mated in a similar manner as described above to electrically connect the plug connector 112 to the receptacle contacts 142.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

What is claimed is:

1. A connector system comprising:

a receptacle connector comprising a receptacle housing having a front and a rear opposite the front, the front having a front opening, the receptacle housing having a top and a bottom, the top having a top opening open to the front opening, the receptacle housing having a cavity accessible through the front opening and the top opening, the receptacle connector having a receptacle connector platform below the cavity supporting receptacle contacts, the receptacle connector platform being angled relative to the front and being angled relative to the top, the receptacle contacts being accessible from above for mating; and a first plug connector received in the cavity through the front opening, the first plug connector having a plug housing holding plug conductors, the plug housing having a top and a bottom, the plug housing having a mating end and a cable end with a cable extending from the cable end, the plug housing having a plug connector platform at the bottom having a mating interface with the plug conductors exposed at the mating interface, the plug connector platform being angled at a complementary angle to the receptacle connector platform for mating the plug conductors with the receptacle contacts.

2. The connector system of claim 1, wherein the receptacle housing includes a first side wall and a second side wall, the top opening extending between the first side wall and the second side wall such that the entire receptacle connector platform is exposed through the top opening.

3. The connector system of claim 2, wherein the first and second side walls include ledges, the top of the plug housing engaging the ledges to hold the plug conductors against the receptacle contacts.

4. The connector system of claim 1, further comprising a seal between the plug connector platform and the receptacle connector platform to entirely seal around the mating interface.

5. The connector system of claim 1, wherein the first plug connector includes latches engaging the receptacle housing, the latches holding the first plug connector in the cavity.

6. The connector system of claim 5, further comprising a seal between the plug connector platform and the receptacle connector platform, the latches pulling the plug connector platform toward the receptacle connector platform to compress the seal therebetween.

7. The connector system of claim 1, wherein the receptacle housing includes a base configured to be mounted to a wearable article.

8. The connector system of claim 1, wherein the receptacle connector platform includes a backing plate behind the receptacle contacts, the backing plate holding mating ends of the receptacle contacts coplanar along a mating plane parallel to the top of the receptacle housing.

9. The connector system of claim 1, wherein the receptacle housing includes receptacle guide features and the plug housing includes plug guide features, the plug guide features engaging the receptacle guide features to locate the plug housing relative to the receptacle housing.

10. The connector system of claim 1, wherein the receptacle connector and the plug connector mate in a mating direction parallel to the top of the receptacle housing.

11. The connector system of claim 1, wherein the plug housing holds a circuit board having the plug conductors defined by circuits of the circuit board at a mating side of the circuit board, the circuit board being terminated to the cable.

12. The connector system of claim 1, wherein the receptacle connector platform is a front receptacle connector platform, the receptacle housing having a rear opening at the rear and a rear receptacle connector platform angled relative to the rear and angled relative to the top, the rear receptacle connector platform being angled away from the front receptacle connector platform, the front receptacle connector platform being angled away from the rear receptacle connector platform.

13. The connector system of claim 1, wherein the plug housing includes a first side and a second side between the top and the bottom, the first plug connector having a first latch at the first side and a second latch at the second side, the first and second latches being deflectable.

14. The connector system of claim 13, wherein the first latch includes an angled latching wall engaging a latching surface of the receptacle housing to drive the first plug connector into the cavity.

15. A connector system comprising:

a receptacle connector comprising a receptacle housing having a front and a rear opposite the front, the front having a front opening, the rear having a rear opening, the receptacle housing having a top and a bottom, the top having a top opening open to the front opening and the rear opening, the receptacle housing having a cavity accessible through the front opening, the rear opening and the top opening, the receptacle connector having a base below the cavity at the bottom of the receptacle housing, the base having a front receptacle connector platform proximate to the front and a rear receptacle connector platform proximate to the rear, the front receptacle connector platform being angled relative to the front and being angled relative to the top, the rear receptacle connector platform being angled relative to the rear and being angled relative to the top, the base supporting receptacle contacts extending between and exposed at the front receptacle connector platform and the rear receptacle connector platform;

a first plug connector received in the cavity through the front opening, the first plug connector having a first plug housing holding first plug conductors, the first plug housing having a top and a bottom, the first plug housing having a mating end and a cable end with a cable extending from the cable end, the first plug housing having a first plug connector platform at the bottom having a first mating interface with the first plug conductors exposed at the first mating interface, the first plug connector platform being angled at a complementary angle to the first receptacle connector platform for mating the first plug conductors with the receptacle contacts; and a second plug connector received in the cavity through the rear opening, the second plug connector having a second plug housing holding second plug conductors, the second plug housing having a top and a bottom, the second plug housing having a mating end and a cable end with a cable extending from the cable end, the second plug housing having a second plug connector platform at the bottom having a second mating interface with the second plug conductors exposed at the second mating interface, the second plug connector platform being angled at a complementary angle to the second receptacle connector platform for mating the second plug conductors with the receptacle contacts, wherein the receptacle contacts electrically connect the first and second plug conductors.

16. The connector system of claim 15, wherein the receptacle housing includes a first side wall and a second side wall, the top opening extending between the first side wall and the second side wall and extending between the front and the rear such that the entire front receptacle connector platform and the entire rear receptacle connector platform are exposed through the top opening.

17. The connector system of claim 15, wherein the first plug connector includes first latches engaging the receptacle housing and the second plug connector includes second latches engaging the receptacle housing, the first latches pulling the first plug connector toward the second plug connector, the second latches pulling the second plug connector toward the first plug connector.

18. The connector system of claim 15, wherein the first and second plug connectors are identical and configured to be received in the cavity through either of the front opening and the rear opening.

19. The connector system of claim 15, wherein the first plug housing holds a circuit board having the first plug conductors defined by circuits of the circuit board at a mating side of the circuit board.

20. A connector system comprising:

a receptacle connector comprising a receptacle housing having a front and a rear opposite the front, the front having a front opening, the receptacle housing having a top and a bottom, the top having a top opening open to the front opening, the receptacle housing having a cavity accessible through the front opening and the top opening, the receptacle connector having a receptacle connector platform below the cavity supporting receptacle contacts, the receptacle connector platform being angled relative to the front and the being angled relative to the top, the receptacle contacts being accessible from above for mating; and a first plug connector received in the cavity through the front opening, the first plug connector having a plug housing holding a circuit board having plug conductors defined by circuits of the circuit board at a mating side of the circuit board, the plug housing having a top and a bottom, the plug housing having a mating end and a cable end with a cable extending from the cable end, the cable being terminated to the circuit board to electrically connect with corresponding plug conductors, the plug housing having a plug connector platform at the bottom having a mating interface, the mating side of the circuit board and the plug conductors being exposed at the mating interface, the plug connector platform being angled at a complementary angle to the receptacle connector platform for mating the plug conductors with the receptacle contacts.

* * * * *